US005563637A

United States Patent [19]

Francis et al.

[11] Patent Number: 5,563,637

[45] Date of Patent: Oct. 8, 1996

[54] MAINTENANCE STATION FOR INK JET PRINTHEAD

[75] Inventors: Monty L. Francis, Lexington; Paul Harrington III, Versailles; Randall D. Mayo, Georgetown; Katherine A. Profitt; Donald N. Spitz, both of Lexington, all of Ky.

[73] Assignee: Lexmark International, Inc., Greenwich, Conn.

[21] Appl. No.: 143,328

[22] Filed: Oct. 26, 1993

[51] Int. Cl.[6] ..... B41J 2/165

[52] U.S. Cl. ..... 347/32; 347/23; 347/33; 318/469

[58] Field of Search ..... 347/5, 22, 23, 347/29, 30, 32, 19, 33; 318/468, 469, 470

[56] References Cited

U.S. PATENT DOCUMENTS

| | | | |
|---|---|---|---|
| 4,567,494 | 1/1986 | Taylor | 347/30 |
| 4,641,067 | 2/1987 | Iizawa et al. | 318/469 |
| 5,027,134 | 6/1991 | Harmon et al. | 347/29 |
| 5,097,276 | 3/1992 | Midorikawa | 347/32 |
| 5,103,244 | 4/1992 | Gast et al. | 347/33 |
| 5,115,250 | 5/1992 | Harmon et al. | 347/33 |
| 5,146,243 | 9/1992 | English et al. | 347/29 |
| 5,148,203 | 9/1992 | Hirano | 347/32 |
| 5,151,715 | 9/1992 | Ward et al. | 347/33 |
| 5,155,497 | 10/1992 | Martin et al. | 347/32 |
| 5,164,748 | 11/1992 | Katayanagi et al. | 347/30 |
| 5,187,497 | 2/1993 | Hirano et al. | 347/8 |
| 5,216,449 | 6/1993 | English | 347/29 |
| 5,394,178 | 2/1995 | Grange | 347/32 |

FOREIGN PATENT DOCUMENTS

| | | | |
|---|---|---|---|
| 57-187259 | 11/1982 | Japan | 347/32 |

*Primary Examiner*—John E. Barlow, Jr.
*Attorney, Agent, or Firm*—B. Franklin Griffin, Jr.

[57] ABSTRACT

A maintenance station for an ink jet printer comprises two modules supported from the printer middle frame by a tongue and groove arrangement and secured in place only by retaining elements integrally formed with the middle frame. The first module includes a wiper element and a cap to provide an air seal around the nozzles. The wiper and cap are mounted on a pivoted rocker element so that as the wiper is moved toward the printhead the cap is moved away therefrom and visa-versa. The second module carries a small DC motor, a nut with a pair of forked arms, and gearing for converting bidirectional rotation of the motor into linear reciprocal motion of the forked arms. The forked arms engage projections on the rocker element so that the wiper or cap is moved toward or away from the printhead depending on the direction of rotation of the motor. In a first position of the rocker element the wiper is positioned in the path of the printhead so as to wipe the nozzles as the printhead is moved back and forth. In a second position the cap presses against the printhead to form an air seal around the nozzles. In a third position the wiper and cap are both spaced away from the path of the printhead and below the plane of the record feed path. The printer controller senses motor current and controls positioning of the rocker element without the need for a position feedback encoder.

26 Claims, 7 Drawing Sheets

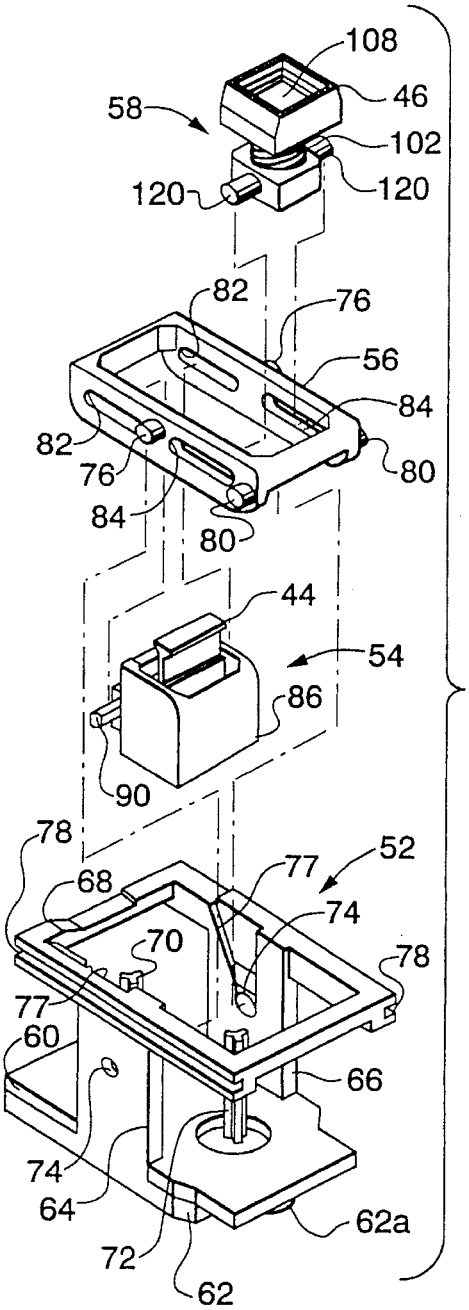
Fig. 4
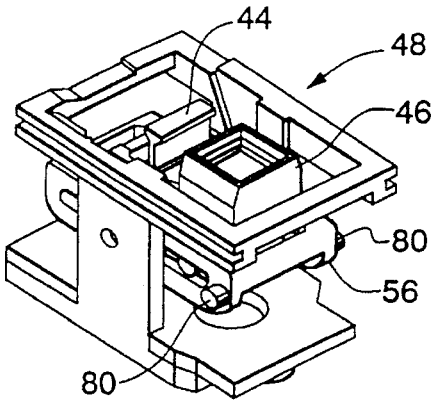
Fig. 5
Fig. 3
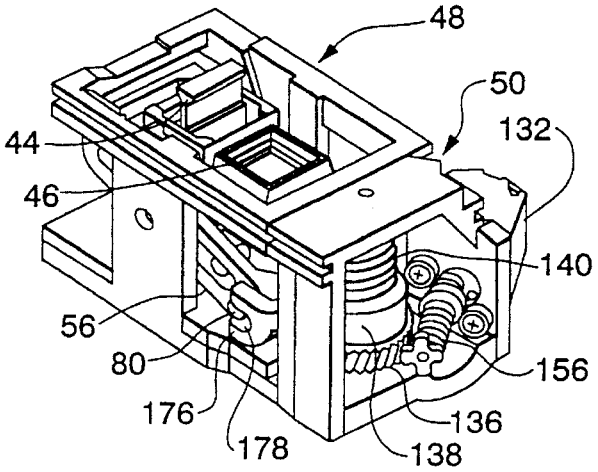

Fig. 11
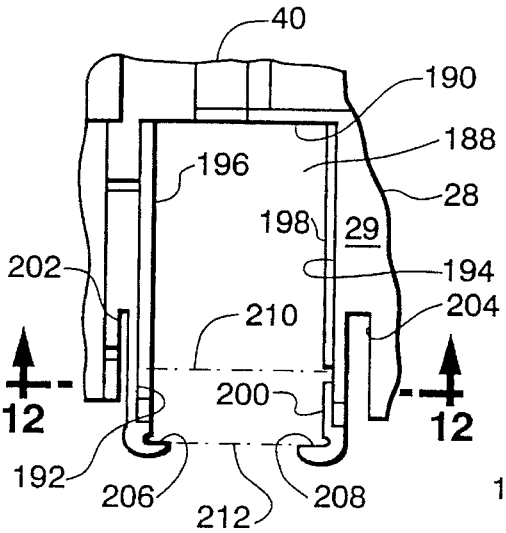
Fig. 8
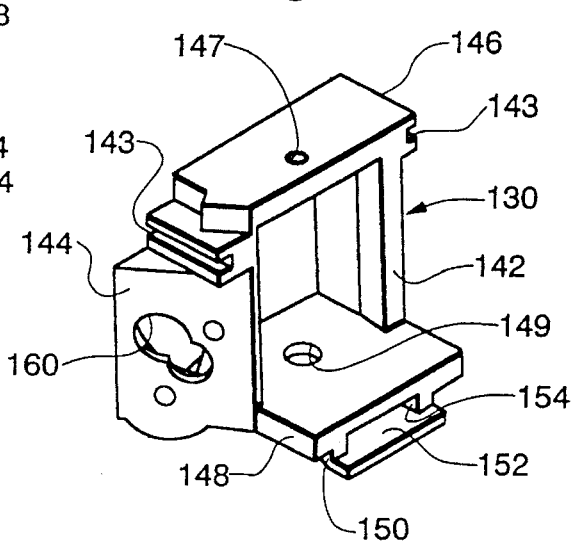
Fig. 12
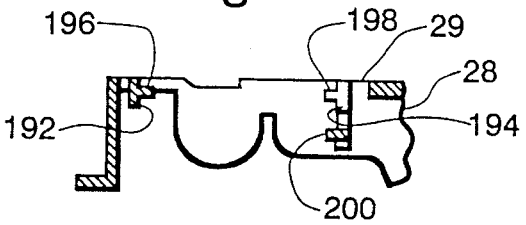
Fig. 6
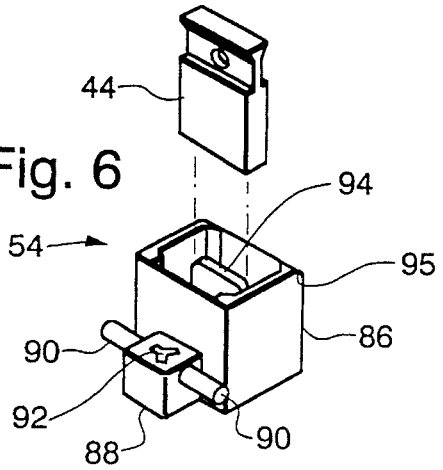
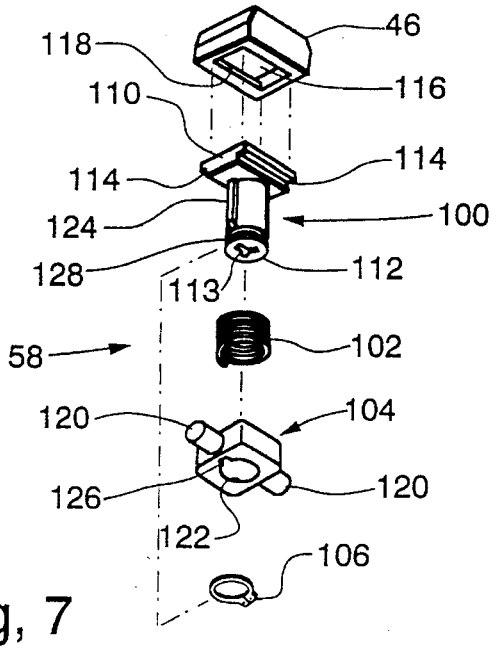
Fig, 7

MAINTENANCE STATION FOR INK JET PRINTHEAD

FIELD OF THE INVENTION

The invention relates to a maintenance station for wiping accumulated ink and dust from the nozzles of an ink jet printer and forming an air seal around the nozzles when printing is not taking place.

BACKGROUND OF THE INVENTION

In an ink jet printer, a record sheet is typically fed to a sheet stacker immediately after the ink is applied to the record sheet. To reduce smudging during stacking and subsequent handling, very fast-drying inks are used. These inks have the disadvantage in that there is a tendency for the ink to dry and clog the nozzles if not used for a period of time. To solve this problem it has been conventional to provide a cap, that is, a cup-shaped cover which cooperates with the printhead when it is not in use to form an air seal around the nozzles, thereby slowing the drying of ink in the nozzles.

There is also a tendency during printing for ink to mix with dust and paper fibers and dry on the printhead surface surrounding the nozzles thus interfering with ejection of ink from the nozzles. The prior art alleviates this problem by providing a wiper which extends into the path of travel of the printhead and wipes ink from the printhead surface surrounding the nozzles as the printhead is moved back and forth relative to the wiper.

The prior art teaches that the wiper and cap may be disposed in a maintenance or service station located to one side of the record feed path. The reason for choosing this location is that in some cases the wiper and/or cap are fixedly mounted at a height such that they extend through the plane of the feed path. In other cases mechanisms are provided for moving the wiper or cap into operative positions and, as described for example in U.S. Pat. Nos. 5,115,250, 5,103,244 and 5,027,134, these mechanisms include elements which themselves extend through the plane of the record feed path.

The cap is normally made of a resilient material so that it will conform to the printhead surface around the nozzles and form an air seal therewith. The cap is also made resilient to reduce wear and possible damage to the printhead. To reduce wear of the resilient cap, the patents mentioned above propose mounting the cap on a sled which is pushed up a ramp as the printhead is moved into the capping position. The ramp provides a vertical component of movement of the cap toward the printhead but at the same time it also provides a horizontal component of movement which, if not synchronized with movement of the printhead into capping position, will still result in cap wear because of a wiping action between the cap and the printhead.

SUMMARY OF THE INVENTION

An object of the present invention is to provide a maintenance station for a printhead, the maintenance station including a wiper, a cap and components for selectively moving the wiper or the cap into a wiping or capping position, the components of the maintenance station being located entirely on one side of the plane of record feed whereby the maintenance station may be mounted directly below the record feed path.

Another object of the invention is to provide a maintenance station for a printhead, the maintenance station having a configuration permitting it to be mounted at any location along and underneath the path of printhead movement.

A further object of the invention is to provide a maintenance station which comprises only two modules which may be installed or removed without the use of any tools.

Still another object of the invention is to provide a maintenance station comprising a rocker module having a wiper and cap therein moved along parallel paths by a rocker element to raise either the wiper or cap into the path of the printhead, and a drive module including a motor for rocking the rocker element.

Another object of the invention is to provide a maintenance station for a printhead, the station comprising two modules positioned below the plane of record feed, one of the modules including a mechanism for alternately raising a cap or a wiper into contact with the printhead and the other module including a motor and gearing for driving the mechanism in the first module.

A further object of the invention is to provide a maintenance station having a rocker module including a wiper and a cap mounted for linear reciprocal movement along parallel paths toward and away from the path of the printhead, the rocker module including a pivoted rocker element for simultaneously moving the wiper and cap in opposite directions, and a drive module for driving the rocker element between a first position where the cap engages the printhead, a second position where the wiper engages the printhead, and a third position where the wiper and cap are both withdrawn from the printhead.

Another object of the invention is to provide a maintenance station as described above wherein the drive module includes a DC drive motor for driving a worm gear, a helical gear driven by the worm gear, a power screw interlocked with the hub of the helical gear, and a nut driven by the power screw for pivoting the rocker element provided in the rocker module. One face of the helical gear is provided with thread-like projections with blunt ends and the nut threads also have blunt ends so that movement of the nut into engagement with the face of the gear is prevented.

Still another object of the invention is to provide a maintenance station as described above wherein no encoder is provided on the drive motor for determining the position of the rocker element. Each time the printer is turned on, a microprocessor based controller executes a routine during which it applies a voltage to the motor and senses the motor current which increases when the motor is stalled, that is, when the rocker module is in the cap up or wiper up position. The algorithm derives a time value which represents the time the motor must be energized to move the rocker element from either the cap up or wiper up position to the middle or third position where the wiper and cap are both withdrawn from the printhead. The time value may then be used to energize the motor to move the rocker element between the cap up or wiper up position and the middle position.

Other objects of the invention and the manner of making and using it will become obvious from the following description and the accompanying drawings.

BRIEF DESCRIPTION OF THE DRAWINGS

FIG. 3 is a perspective view of a maintenance station comprising a rocker module and a power module, the rocker module being in position to wipe a printhead;

FIG. 4 is an exploded perspective view of the rocker module;

FIG. 5 is a perspective view of the rocker module in a position where the cap and the wiper are both below the record feed path;

FIG. 6 is an exploded view of a wiper assembly;

FIG. 7 is an exploded view of a cap assembly;

FIG. 8 is a perspective view of the frame for a power module;

FIG. 11 is a top view of a portion of the printer middle frame surrounding the maintenance station;

FIG. 12 is a sectional view taken along the line 12—12 of FIG. 11; and, FIGS. 13A–13D, when taken together, comprise a flow diagram of a program executed by the printer controller at start-up to determine the time the maintenance station drive motor must be energized to move the rocker element from a cap up or a wiper up position to a midpoint position where both the wiper and the cap are withdrawn from the printhead.

DESCRIPTION OF A PREFERRED EMBODIMENT

Figure 1:
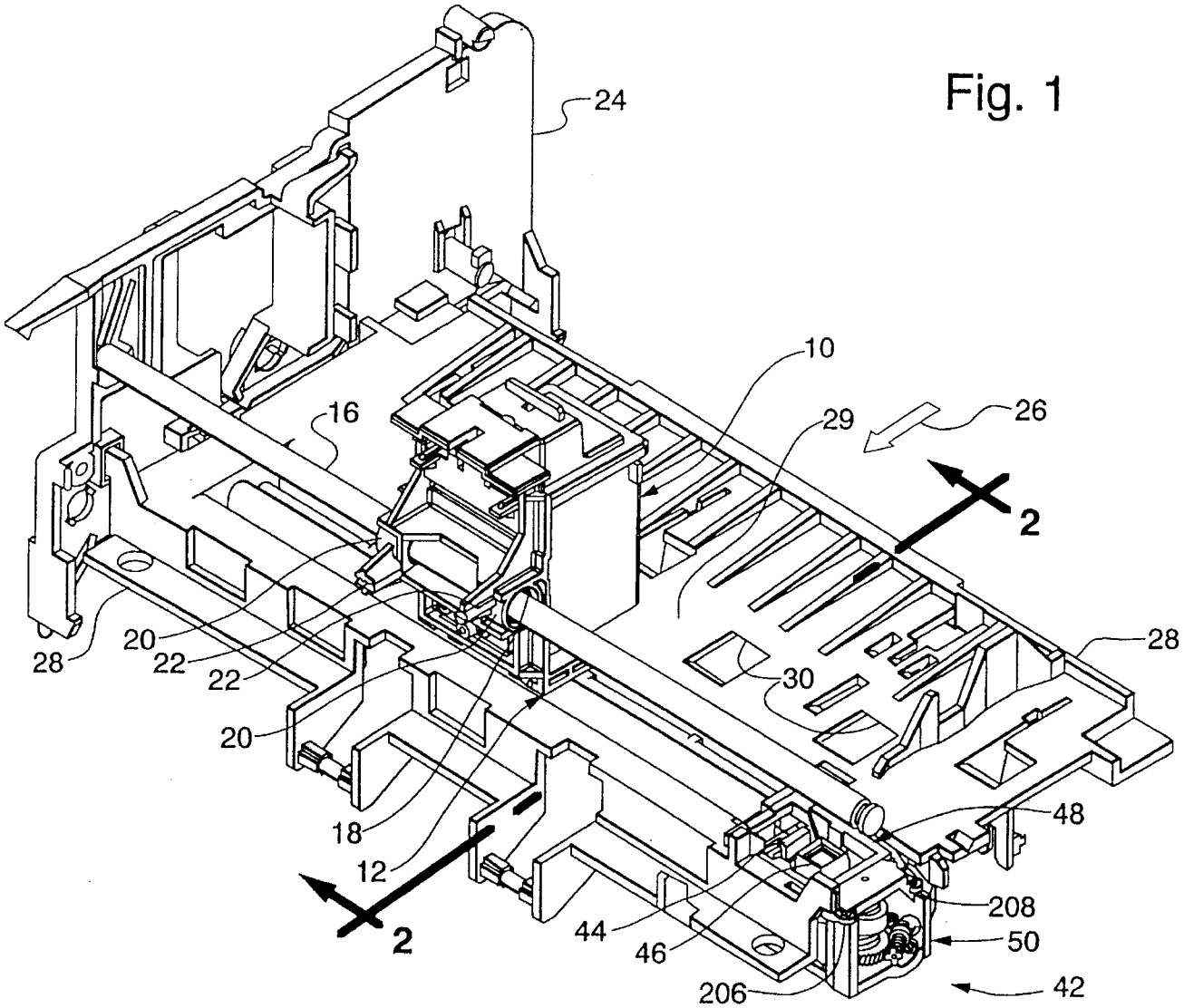
FIG. 1 is a perspective view of a portion of a printer showing an ink jet printhead and a maintenance station for the printhead.
Figure 2:
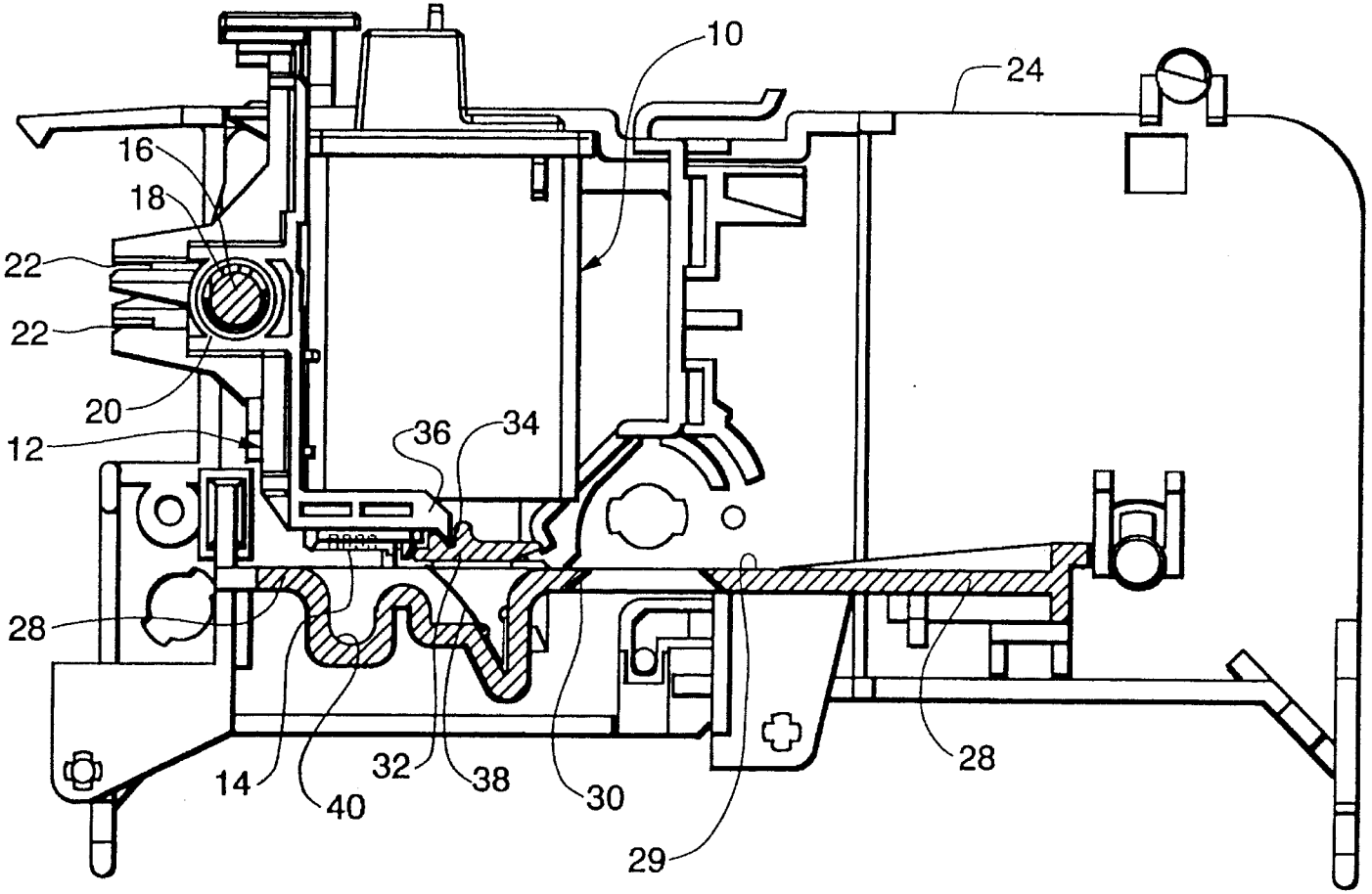
FIG. 2 is a sectional view taken along the line 2—2 of FIG. 1.

Referring to FIGS. 1 and 2, a printhead 10 is mounted on a printhead carrier assembly 12. The printhead 10 is conventional in that it includes a plurality of ink jet nozzles 14 located in a bottom or nozzle surface, and an ink supply and controls (not shown) for controlling the nozzles to eject ink therefrom.

The carrier assembly 12 is supported on a guide rod 16 by slide bearings 18 housed within two bearing housings 20. The carrier assembly includes two sets of belt gripper jaws 22. The gripper jaws, together with a belt driven by a bi-directional motor (not shown), comprise a means for moving the carrier assembly and printhead back and forth along guide rod 16.

The guide rod 16 is supported by two side frames 24, only one of which is shown. The guide rod extends transverse to the direction of record feed, indicated by arrow 26, and is located above the record feed path. A molded plastic bed plate or middle frame 28 is mounted between side plates 24 and has an upper surface 29 which defines the lower side of the record feed path. A record sheet is advanced through the printer by feed rolls (not shown) in a conventional manner. Middle frame 28 is provided with a plurality of holes 30 so that feed rolls located below the frame may coact with feed rolls above the frame to feed a record sheet along the top surface of the middle frame and under a guide rail 32. The guide rail 32 is provided with a groove 34 in which two feet 36 of the carrier assembly 12 ride as the carrier assembly is moved back and forth over the record feed path. An elongated plastic leaf spring 38 presses a record upward against the bottom of guide rail 32 so that the upper surface of the record is a fixed distance from the nozzles 14 as the record passes under the nozzles.

Printing takes place in a conventional manner. As a record sheet is fed under nozzles 14 in the direction of arrow 26, the printhead carrier assembly is moved back and forth over the record sheet as ink within the printhead is ejected from the nozzles 14. A microprocessor-based controller 184 (FIG. 10) provides electrical signals to the printhead to control ejection of ink from the nozzles.

The middle frame 28 is molded so as to provide a trough 40 located below the record feed path. The trough extends transverse to the record feed path and is located directly underneath the path of travel of the ink jet nozzles 14. The purpose of trough 40 is to collect ink in the event the nozzles 14 eject ink when a record is not present underneath the nozzles. This might occur if an operator incorrectly programs the printer in a manner inconsistent with the size of the record sheets being used, or if a paper feed jam should occur. The trough collects the ink and it dries therein. Thus, ink is not ejected onto the record feed path where it might be picked up on succeeding record sheets. Furthermore, collection of ink in the trough 40 prevents the ink from being spread to mechanical parts and sensitive electrical components. A felt pad (not shown) may be included in the trough to absorb ink received therein and facilitate drying of the ink.

According to the present invention, a maintenance or cleaning station 42 is provided for cleaning nozzles 14 and capping them, that is, forming an air seal around them to prevent ink from drying in them. As shown in FIG. 1, the maintenance station 42 is suspended from middle frame 28 at one side of, and below, the record feed path. The maintenance station includes a wiper 44 and a cup-shaped cap 46. Briefly, a wiping sequence commences with the printhead over the record feed path and the top of the wiper 44 below the record feed path. The wiper is raised until it extends into the path of the printhead surface containing the nozzles, and the printhead is moved to the right as viewed in FIG. 1. Accumulated ink and other foreign matter is wiped from the printhead as the printhead moves past the wiper. One pass of the printhead past the wiper has been found sufficient to adequately clean the nozzle surface.

In a capping operation the printhead is moved over cap 46 and the cap raised into contact with the printhead so as to form an air seal around the region in which the nozzles are located.

Figure 10:
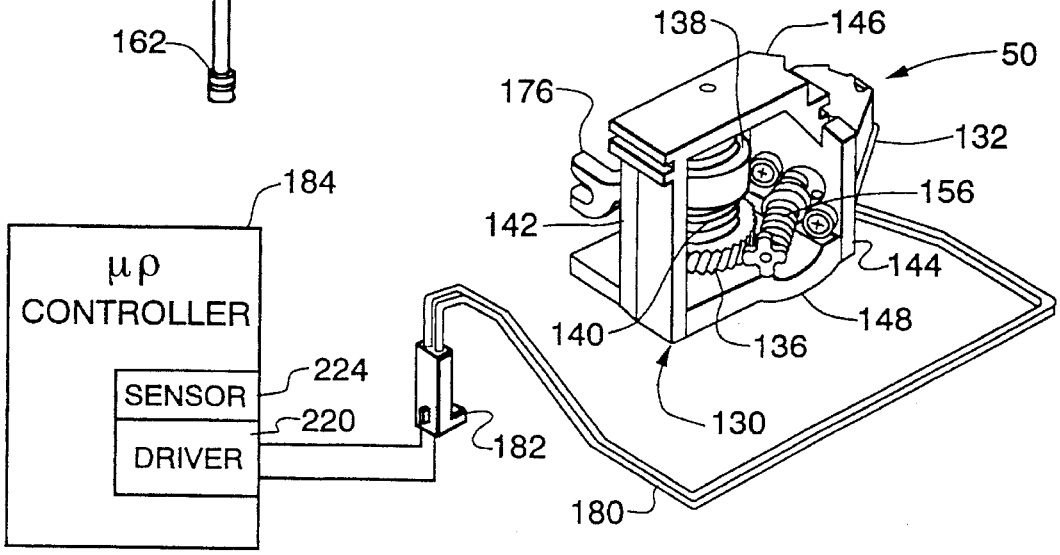
FIG. 10 is a perspective view of a power module.

The maintenance station 42 comprises a rocker module 48 (FIG. 5) and a power or drive module 50 (FIG. 10). The wiper 44 and cap 46 are located on the rocker module and the drive module provides drive power for moving the wiper and cap up and down. The modules 48 and 50 are not fastened together and may be removed from frame 28 and separated without the use of any tool, as subsequently described. FIG. 3 shows modules 48 and 50 in operative relationship to each other, this particular figure showing the wiper in the position to which it is raised for performing a wiping operation.

Referring now to FIGS. 4–7, the rocker module 48 comprises a rocker frame 52, a spit cup assembly 54, a rocker element 56, a cap assembly 58 and an ink-absorbent-pad 60.

Rocker frame 52 comprises a generally open framework including a bottom plate 62, opposing side walls 64, 66 and a top member 68. The rocker frame may be a material such as Thermocomp DFL-4034 sold by LNP Corporation. This material is polycarbonate containing 20% glass and 15% PTFE. Two fluted guide posts 70, 72 are integrally molded with bottom plate 62.

The opposing side walls 64, 66 are each provided with a hole 74. These holes receive projections or pivot pins 76 integrally formed on the sides of rocker element 56. The top member 68 is provided with two grooves 78 extending along the entire length of the sides. These grooves are used to mount the rocker module 48 on the middle frame 28 (FIG. 1) as described later.

When the pivot pins 76 of rocker element 56 are positioned within holes 74 the rocker element may be pivoted about the pins in a see-saw like manner. Force for pivoting the rocker element is applied to two projections 80 extending outwardly from the sides of the rocker element. This force is applied to projections 80 by two forked arms 176 (FIGS. 3 and 9) on the drive module 50.

Rocker element 56 has a first pair of elongated slots 82 and a second pair of elongated slots 84, one slot of each pair extending through a side wall of the rocker element and the other slot of each pair extending through the opposing side wall. Slots 82 receive two pins 90 provided on the spit cup assembly 54 and slots 84 receive two pins 120 provided on the cap assembly 58.

As shown in FIG. 6, the spit cup assembly 54 comprises a cube-like cup portion 86, open at the top and having a mounting block 88 extending from one side. Two pins 90 extend in opposite directions from the sides of block 88. A hole 92 extends vertically through the block. Hole 92 is sized and shaped to fit and slide freely on the post 70 (FIG. 4) while inhibiting rotation of the block about the post. A generally flat mounting element 94 is integral with the cup portion 86 and extends vertically from the bottom of the cup. The wiper element 44 has a slot extending upwardly from its bottom surface and the wiper is mounted on the mounting element 94 by forcing the wiper downwardly so that the mounting element is forced into the slot. The wiper 44 is the subject of a copending application and preferably is made of Texin 480-A (Miles, Inc.) as described therein although other elastomeric materials may be used.

The purpose of cup 86 is to catch ink wiped from the printhead by the wiper. Pad 60 absorbs ink which may miss the cup.

The cup 86 and the cap 46 move in opposite directions along parallel paths and quite close to each other. During capping, the bottom of the cap may be above the cup 86. Therefore, the cup is rounded at one corner as indicated by numeral 95 to prevent the cap from "hanging up" on the cup in the event they should become misaligned.

As shown in FIG. 7, the cap assembly 58 comprises the cap 46, a cap mount 100, a compression spring 102, a cap slide 104 and a retaining ring or clip 106. Cap 46 is a generally rectangular body having a rectangular recess 108 (FIG. 4) in its upper surface. The cap may be made of SANTOPRENE 111-45, an ethylene propylene diene monomer sold by Monsanto Company, Inc., or a similar elastomeric material which will conform to the surface of the printhead in a region surrounding nozzles 14 so as to form an air seal around the nozzles.

The cap mount 100 comprises a flat plate 110 having a downwardly extending guide mount portion 112. A hole 113 extends longitudinally through the cap mount 100. The hole 113 is sized and shaped to permit sliding movement of the cap mount on the guide post 72 (FIG. 4) without rotation. The plate 110 is undercut on two opposing sides as indicated at 114. The cap 46 is formed to have a rectangular hole 116 in its bottom with two ribs extending laterally into the hole from opposite sides. The ribs 118 grip the plate 110 along the undercuts 114 to hold the cap on the cap mount 100.

The guide posts 70, 72 each have a tri-ribbed, or tri-lobular, shape corresponding with the shape of each mating hole 92, 113. For a given clearance between the post and the walls of the hole, this shape results in less rotational and/or translational motion of an element, such as the block 88 or the cap mount 100, on the post than occurs with other shapes investigated. The tri-ribbed posts may be made using readily available injection molding tools and require no closer tolerancing than other commonly used-shapes such as square or triangular cross-sections.

The cap slide 104 has two laterally extending pins 120 which extend into the slots 84 (FIG. 4) on the rocker element 56. A hole 122 extends vertically through the cap slide, the hole being sized to permit sliding movement of the guide mount portion 112 of cap mount 100 therein. Rotational movement of the cap mount relative to the slide is prevented by a longitudinally extending ridge or key 124 on guide mount portion 112 and a mating recess 126 provided in the wall defining hole 122.

The cap assembly 58 is assembled by mounting cap 46 on the cap mount 100 and inserting the guide mount portion 112 of the cap mount through spring 102 and the hole in cap slide 104. Retaining ring 106 is then inserted into a peripheral groove 128 provided near the lower end of guide mount portion 112. The retaining ring prevents the force of the compression spring from withdrawing the cap mount from the slide.

The spit cup assembly 54 and the cap assembly 58 may be mounted in the rocker module 48 as follows. The spit cup assembly is inserted into rocker element 56 with the pins 90 at an angle with respect to slots 82. When the pins 90 are in the same plane as the slots, the assembly is rotated until the pins enter the slots. The cap assembly is mounted in a similar manner with pins 120 being inserted into slots 84. The rocker element 56, with the cap and spit cup assemblies therein, is lowered toward bottom plate 62 with the holes 92 and 113 aligned with guide posts 70 and 72, respectively,-so that the guide posts enter the holes. The pivot pins 76 of the rocker element are guided into the holes 74 by recesses 77 in the side walls 64, 66.

Figure 9:
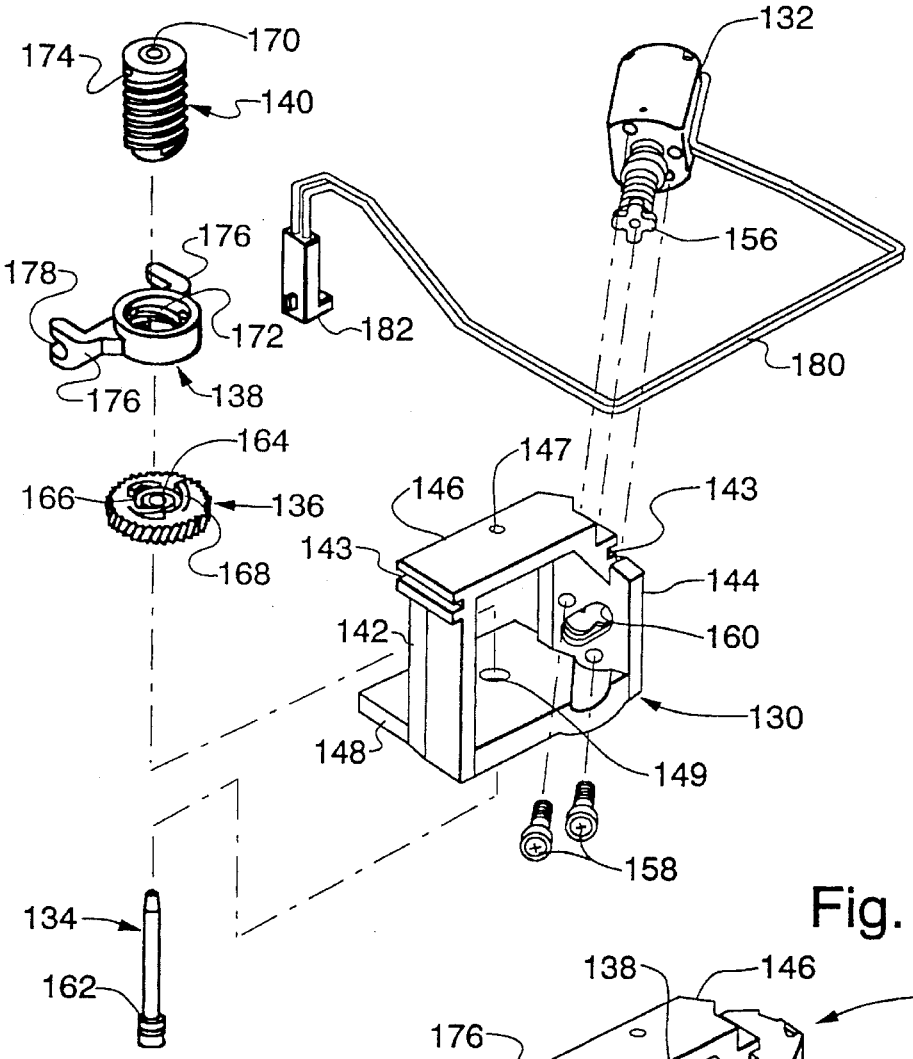
FIG. 9 is an exploded perspective view of a power module.

AS illustrated in FIGS. 9 and 10, the power or drive module 50 comprises a frame 130, a brush type 6 V DC drive motor 132, a worm gear 156, a shaft 134, a helical gear 136, a nut 138 and a power screw 140. Frame 130 may be a monolithic injection molded part made of the same material as the rocker frame 52 and includes two side walls 142, 144, a top member 146 and a bottom plate 148. As shown in FIG. 8, the bottom plate 148 has a downwardly extending portion 150 at one end, the portion 150 having an axially extending tongue 152 which extends beyond one end of plate 148. A slot 154 is formed in an end face of plate 148 and the downwardly extending portion.

When the drive module 50 is brought into operative relationship with the rocker module 48 as illustrated in FIG. 3, the tongue **62*a* (FIG. 4) on the rocker module enters the slot 154 and the tongue 152 slides under the bottom plate 62** of the rocker module so that the two modules are aligned and interlocked.

Side walls 142, 144 are provided with outwardly facing grooves 143. These grooves cooperate with tongues 196 and 200 (FIG. 12) to support the module on the middle frame 28.

Worm gear 156 is mounted on the shaft of motor 132 and the motor is mounted on side wall 144 by screws 158 with the worm gear extending through an opening 160 provided in the side wall. The opening 160 is enlarged so that the motor and worm gear may be easily installed or removed as a unit. The side wall 144 is not parallel to side wall 142 but instead diverges therefrom (see FIG. 8) at an angle of about 35°. This permits mounting of the motor and worm gear at an angle thus permitting a reduction in the overall dimensions of the module.

The shaft 134 is mounted in holes 147 and 149 provided in the top member 146 and the bottom plate 148, respectively. The shaft may be force-fit into member 146 and plate 148 or otherwise fixed so that it does not rotate and cannot move axially. Helical gear 136 is freely rotatable about shaft 134. A shoulder 162 on the shaft abuts the face of the gear so that the gear is spaced from bottom plate 148 and the gear teeth are properly positioned in engagement with the worm gear 156.

The gear 136 may be a plastic gear made from Delrin 500PNC10 commercially available from Dupont Corporation. A hole 164 extends through the gear to permit mounting of the gear for rotation on shaft 134. The upper face of the gear is recessed to form a hub 166 having a non-circular periphery. Three power stops 168 in the form of partial threads with blunt ends extend upwardly from the face of the gear.

The power screw 140 has an axially extending hole 170 to permit mounting of the screw for rotation about shaft 134. The bottom surface of screw 140 has a recess therein which matches the shape of the hub 166 on gear 136. When the gear 136 and screw 140 are mounted on shaft 134, the bottom portion of the screw surrounds the hub 166 so that the screw is interlocked with and rotates with the gear. The power stops 168 fit into the thread grooves on the screw.

The nut 138 may be made of the same material as helical gear 136. The nut is internally threaded and mounted on screw 140 so that the nut moves axially on the screw as the screw rotates. The nut threads 172 are shaped with blunt ends. When the screw 140 rotates to lower nut 138 toward gear 136, the ends of the threads 172 engage the blunt ends of power stops 168 just prior to the time the lower surface of the nut engages the upper surface of the gear. This prevents the nut from being driven into a binding engagement with the gear, an engagement which the small motor 132 might not be able to overcome.

When the power screw 140 is rotated so as to move nut 138 upwardly, the ends of threads 172 engage blunt ends 174 of the grooves on screw 140 thus preventing the nut from being driven into binding engagement with the lower surface of the top frame member 146.

The nut 138 is provided with two L-shaped arms 176 which have forked outer ends forming slots 178. The slots 178 receive projections 80 on the rocker element 56 when the rocker module 48 and the drive module 50 are brought into operative relationship as shown in FIG. 3.

The construction of the drive module 50 provides several advantages. Since the frame 130 may be a single injection molded part, and holes for mounting the motor 132 and shaft 134 may be precisely located during forming of the frame, assembly may be quickly and easily accomplished without regard to positional variability such as exists in units requiring plural mounting components. The power stops 168 and 174 permit reduction in the power, and thus the size, required for the motor. Finally, the drive module provides a single easily removable module for translating bi-directional rotary movement into linear reciprocal movement.

The motor 132 is connected by a pair of leads 180 and a connector 182 to a microprocessor-based controller 184. As subsequently explained, the controller provides pulse-width-modulated (PWM) pulses of a first or a second polarity to drive the motor in a first or a second direction. Referring to FIG. 3, when the motor 132 is energized, worm gear 156 rotates to drive and rotate helical gear 136 about shaft 134. The screw 140, being interlocked with the hub of gear 136, also rotates. As screw 140 rotates, it moves the nut 138 upwardly or downwardly depending on the direction in which motor 132 is energized. As the nut moves its arms 178 press against pins 80 on rocker element 56 thus causing the rocker element to pivot about pins 76. As the rocker element pivots, the spit cup assembly 54 and the cap assembly 58 move along parallel vertical paths, guided by guide posts 70 and 72, one assembly being moved upwardly and the other downwardly.

FIG. 11 is a top view of the middle frame 28 in the region surrounding the maintenance station. The middle frame 28 is provided with a cut-out or opening 188 bounded by an end wall 190 and two side walls 192, 194. Two projections or tongues 196, 198 are provided on the walls 192 and 194, respectively. The tongue 196 extends the full length of wall 192 whereas the tongue 198 extends only part way along the wall 194. The length of tongue 198 is approximately equal to the length of the top member 68 of the rocker module.

As shown in FIG. 12, the wall 194 extends downwardly and is provided with a second tongue 200. The middle frame is cut away to provide two slots 202, 204 so that the outer ends of side walls 192 and 194 are flexible and may be spread apart. The end of tongue 196 has an inwardly extending hook portion 206 while the end of tongue 200 has an inwardly extending hook portion 208.

The tongues 196 and 198 cooperate with grooves 78 on the rocker module 48 to support the rocker-module on the middle frame 28. The rocker module is mounted by spreading the hook portions 206, 208 as the grooves 78 are aligned with, and then slid along the tongues 196, 198, until the rocker module abuts wall 190. As the top frame member of the rocker module clears the hook portions 206, 208, the side walls snap back, thereby preventing removal of the module unless the hook portions 206, 208 are again spread. When the rocker module 48 is in position with one end of its top frame member 68 abutting wall 190, the other end of the top frame member extends to the broken line 210 shown in FIG. 11.

After the rocker module 48 has been mounted on the middle frame 28, the power module 50 may be mounted. The grooves 143 on the power module frame are aligned with the hook portions 206 and 208 and the power module pressed to spread the hook portions. The tongues 196 and 200 enter grooves 143 so that the power module slides on the tongues until the top and bottom frame members 146, 148 of the power module abut the top and bottom frame members 68 and 62 of the rocker module with the rocker module tongue **62*a* extending into the power module slot 154. The rocker element 56 should be positioned so that as the power module slides into place the pins 80 on the rocker element enter the slots 178 provided on the power module nut 138**.

The hook portions 206 and 208 spring back into position as soon as the power module is in place so as to grip an edge of each side wall as shown in FIG. 1. At this time the top frame member of the power module is positioned between lines 210 and 212 of FIG. 11 and the top surfaces of the rocker and power module frames are flush or coplanar with the upper surface 29 of the middle frame 28. The entire maintenance station is suspended from the middle frame below the level of the record feed path. When the rocker module is in an "inactive" or middle position, that is, when neither wiping nor capping is taking place, the rocker element 56 is held in a position such that the tops of the wiper 44 and cap 46 are below the top surface of the top frame member 68 and equidistant from the path traversed by the printhead nozzles. Thus, if desired, the maintenance station may be located underneath the actual record feed path provided the wiper and cap are aligned with the path of travel of the nozzles.

Since the rocker element 56 must be moved between the cap up position, the wiper up position, and a midpoint position where the wiper and cap are both withdrawn from the printhead, and since no position encoder is provided for feeding the position of the rocker element 56 back to the controller 184, the controller must execute a program each time the printer is turned on in order to determine the time interval the motor 132 must be energized to move the rocker element between positions.

The controller 184 controls the power delivered over leads 180 to the motor 132 by varying the duty cycle of a pulse-width-modulated voltage. The controller includes a driver 220 which delivers pulse-width-modulated (PWM) 13 V pulses of a first or a second polarity to the motor, the controller being capable of dividing the duty cycle into 256 increments in a known manner. Therefore, the average voltage applied to the motor may be varied from 0 to 13 V in increments of about 50 mv.

It is characteristic of DC motors that when the motor is stalled, the motor current increases as the applied voltage is increased, and when the motor is allowed to move it generates a back emf which reduces the current from that found in a stopped motor. Even among mass produced motors of the same type, the winding resistance may vary thereby varying the current-voltage characteristics. Thus, it is necessary to determine the voltage-current characteristic of the particular motor 132 being used in a given printer.

An overcurrent value $I_{oc}$ representing a motor current, hereinafter referred to as an overcurrent, is selected and built into an analog circuit associated with the driver 220. The overcurrent value is arbitrarily selected. It should represent a current greater than the motor current expected in an average motor when the motor is moving.

Figures 13A, 13B:
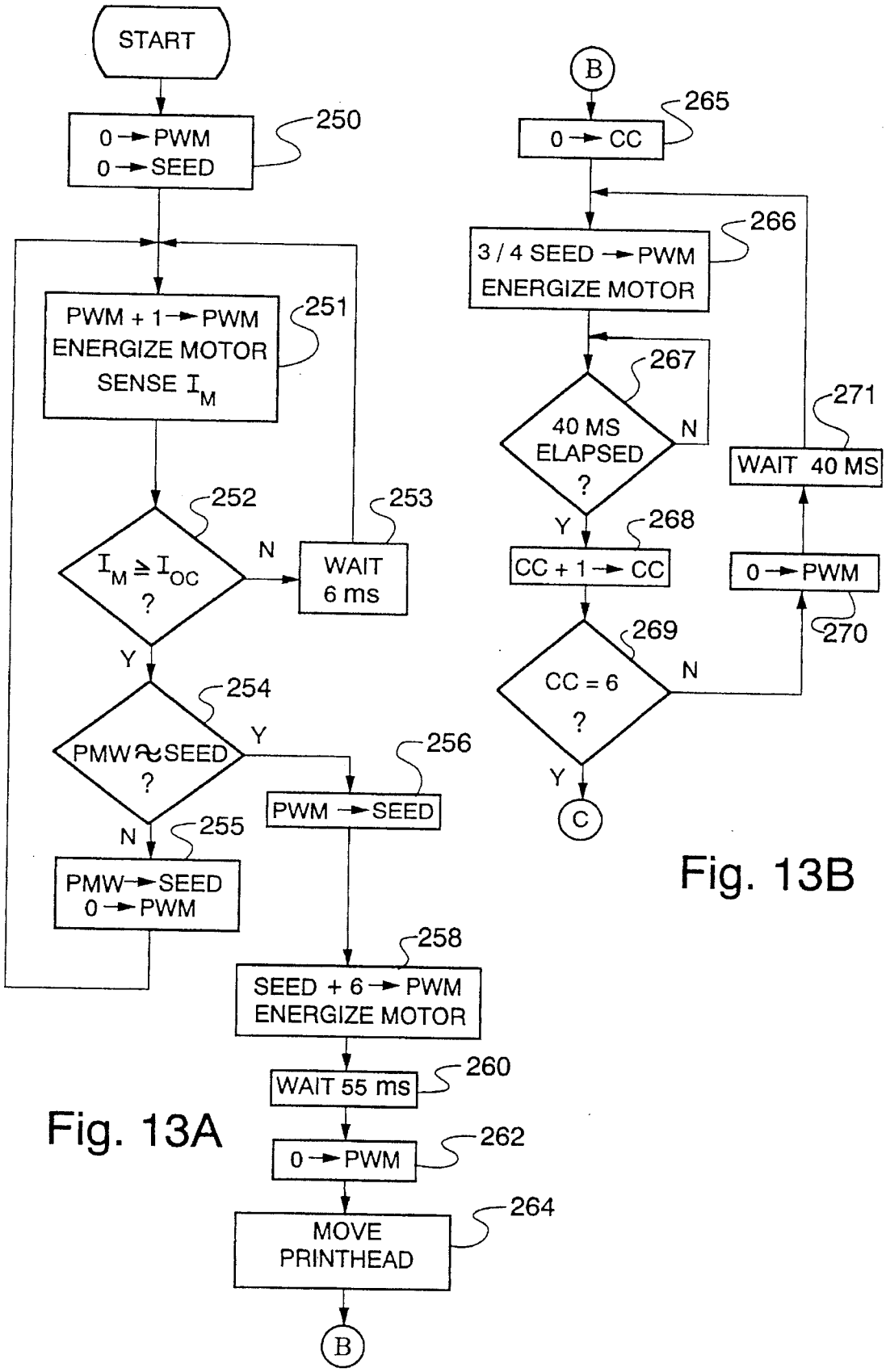

To find the PWM value which gives an overcurrent in the particular motor 132 in use, the controller executes steps 250–256 of the algorithm illustrated in FIG. 13A at printer start-up when power is applied to the controller 184.

At step 250 two registers, SEED and PWM are reset. The PWM register will subsequently hold values used by the controller to determine the width of the pulses applied to the motor. Steps 251–253 are then repeatedly executed. Step 251 increments PWM and the incremented value is used to energize the motor in the cap up direction, that is, the direction which moves the cap into contact with the printhead. The current $I_M$ in the motor is sensed by a current sensor 224 associated with the driver 220. If $I_M > I_{oc}$ a bit is set to 0. If $I_M$ is not equal to or greater than $I_{oc}$, the bit is not set. At step 252 the bit is tested. If it is not a zero the controller waits 6 ms at step 253 and then loops back to repeat steps 251 and 252.

Since the cap should be in its capping position at start-up, the motor should be stalled so that each time PWM is incremented a larger current will be sensed by current sensor 224. If the cap is not fully against the printhead at start up it will be moved by the motor to the capping position before the motor stalls and $I_M$ begins increasing. PWM is repeatedly increased at step 251 until the test at step 252 shows that the motor current is at least as great as the overcurrent.

When the test at step 252 shows that $I_M$ is at least as great as $I_{oc}$, step 254 is executed to see if PWM is approximately equal to SEED. Since SEED was reset at step 250, the test at step 254 proves false. Step 255 is executed to transfer the count in PWM to SEED and PWM is cleared. The program then loops back to step 251.

Steps 251–253 are then repeatedly executed to again increase the motor current until the test at step 252 again shows that the motor current is as great as the overcurrent. When the motor current is again at least as great as the overcurrent, step 254 is executed to compare the value in SEED with the value of PWM. If they are within 5 of each other, step 256 is executed to save PWM at SEED.

If the test at step 254 should again prove false, step 255, and steps 251–254 are again executed as described above. This continues until step 254 reveals that two successive PWM counts (the present count in PWM and the previous count in SEED) are within 5 of each other. This insures that the SEED value is found with the motor stopped.

If the SEED value stored at step 256 were then increased slightly and used as a PWM value to energize the motor in the opposite direction, the motor would move and become a velocity sensor.

After the SEED value is saved at step 256, the motor is energized to move the rocker element to approximately mid-cycle position, where the cap and wiper are both withdrawn from the printhead. At step 258 the value 6 is added to SEED and the sum entered into PWM. The motor is then energized by voltage pulses having the width specified by PWM, the polarity of the pulses being such as to drive the motor in the wiper-up direction. At step 260 the controller waits about 55 ms while the motor drives the rocker element 56. After 55 ms the rocker should be at approximately its midpoint but its exact position is not known. At step 262 PWM is reset and the motor drive voltage terminated. The printhead is then moved away from the maintenance station at step 264.

The controller next prepares for determining the length (i.e. time) of moves from the rocker element midpoint position to its cap up and wiper up positions. Steps 265–271 (FIG. 13B) are executed to move the rocker element to the wiper up position by energizing the motor for a series of 40 ms intervals separated by 40 ms intervals. This is done to avoid driving the nut 138 into contact with the helical gear 136 with too much force. At step 266 a reduced current (⅝ SEED) is used to energize the motor 132. After step 267 tolls a 40 ms interval a counter CC is incremented at step 268 and at step 269 the counter is checked to see if it contains a count of 6. If CC does not hold the value 6, PWM is reset at step 270 to terminate the drive voltage to the motor. After a wait of 40 ms at step 271, the program returns to step 266.

The loop comprising steps 266–271 is executed six times. The six 40 ms energization periods is sufficient to move the rocker element 56 to the wiper up position. On the sixth execution the test at step 269 proves true.

Figure 13C:
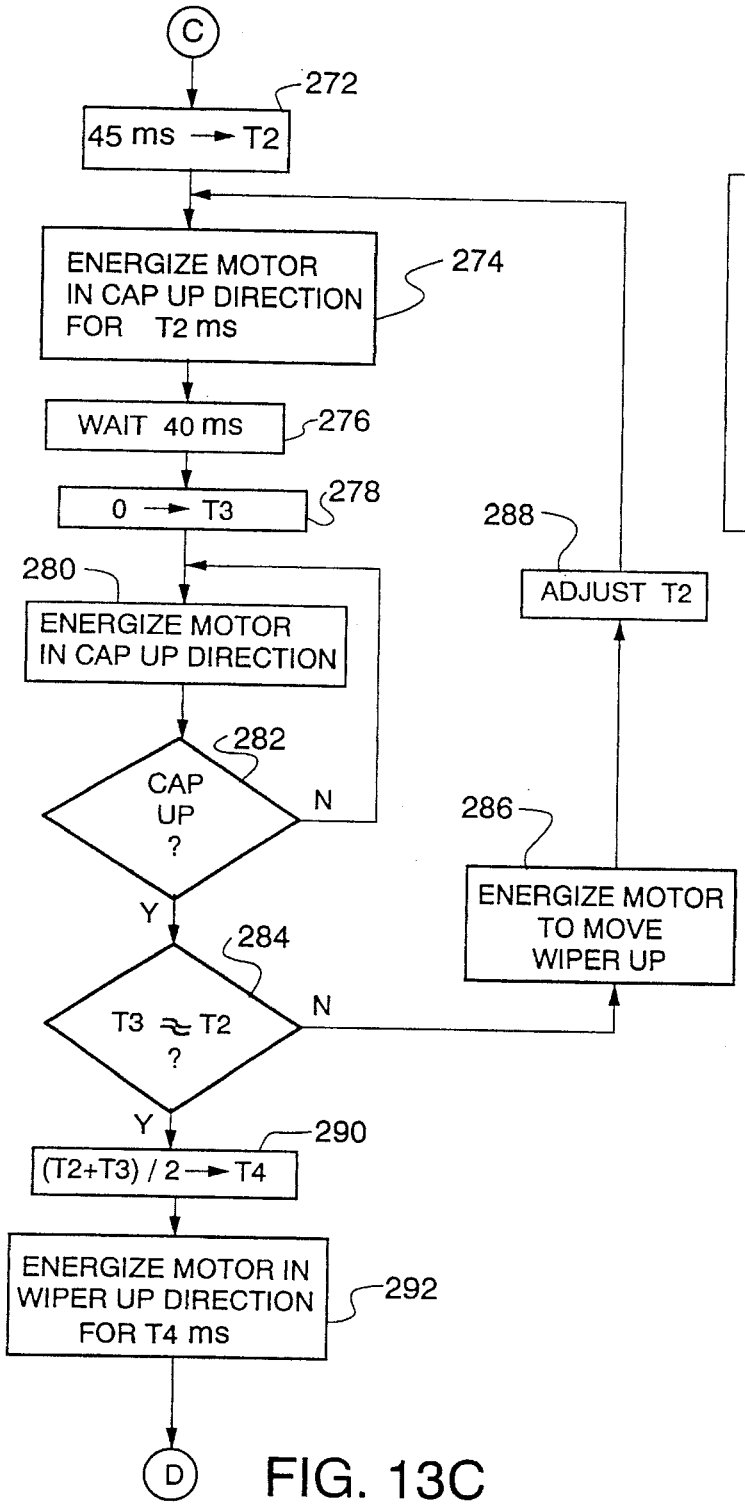
Figure 13D:
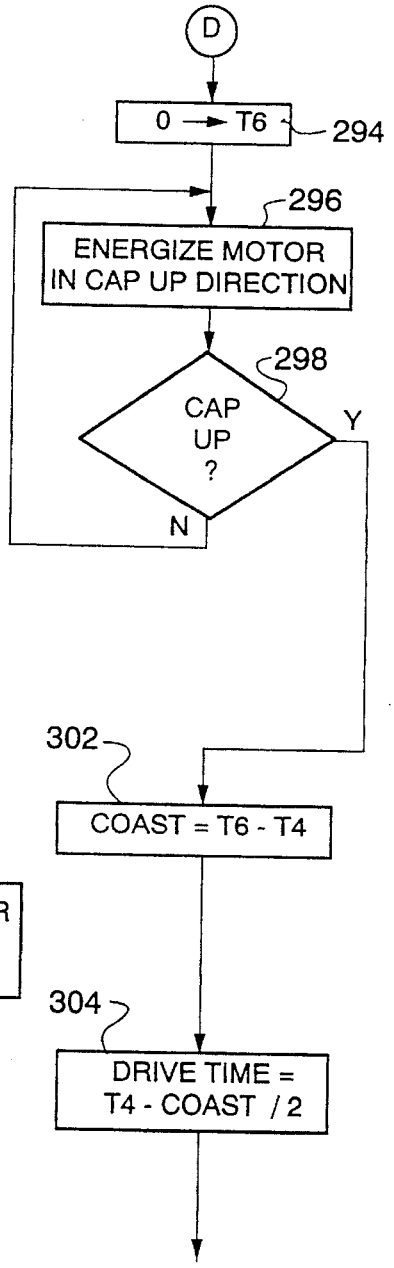

The program is now ready to determine the times of moves from the wiper up or cap up position to the mid-point position. It does this by first finding two times T2 and T3 which are approximately equal (within 7 ms of being equal). In FIG. 13C a timer T2 is set at step 272 to time an interval of 45 ms. At step 274 the motor is energized in a direction to raise the cap. The motor is energized until the timer T2 times out. The controller then waits for 40 ms at step 276. During the wait interval the motor coasts to a stop.

Next, a timer T3 is reset and started (step 278) and the motor is energized (PWM=SEED+6) in the cap up direction (step 280) until the cap is fully raised. The timer T3 times the interval the motor is energized. During the motor energization interval the current sensor 224 senses the motor current $I_M$ and it is compared with $I_{oc}$. When the cap is fully up the motor stalls and the current increases to $I_{oc}$. When the controller senses that $I_M$ is equal to $I_{oc}$ (step 282) it stops driving the motor and stops the timer T3.

At step 284 the value originally entered into T2 is compared with the count developed in timer T3. Assuming that T2 and T3 are not approximately equal (within 7 ms) the motor is energized at step 286 (PWM=SEED+6) to again raise the wiper. The value used to set T2 at step 272 is adjusted by some small value such as 1 ms (step 288) and the adjusted value entered into T2 before a return is made to step 274.

The loop beginning at step 274 is repeatedly executed until step 284 shows that T2 and T3 are approximately equal. As noted above, the move from the wiper up to the cap position in the above measurements involved three intervals: interval T2 in which the motor is energized, the wait interval which includes the motor coast time, and the interval T3 during which the motor is energized. The controller 184 executes steps 290–302 to determine the coast time.

At step 290, a timer T4 is loaded with a value equal to the average between the last determined values of T2 and T3. The motor is then energized (step 292) in the wiper up direction for the interval timed by T4. The motor coasts to a stop at the end of the timed interval.

A timer T6 is then reset and started at step 294 and the motor energized in the cap up direction at step 296. Energization continues until the cap is fully up at which time the current sensor 224 and controller 184 detect (at step 298) the increased motor current ($I_M \geqq I_{oc}$) when the motor stalls. The timer T6 is stopped and the value in T4 is subtracted from T6 (step 302) to get the coast time. Step 304 then subtracts one-half the coast time value from T4 to obtain a drive time value. The drive time value represents the interval of time the motor should be energized to move the rocker element 56 from the cap up or the wiper up position toward its midpoint position so that the motor coasts and the rocker element stops at the midpoint position.

Once step 304 is completed, the controller has determined all the information necessary for driving the motor to position the rocker element. To drive the motor during an actual wiping or capping operation, the motor energization is different depending on whether the motor is moving the rocker element toward the wiper up or cap up direction. For moves in the cap up direction, a move is started using a PWM of SEED+10 for 15 ms after which the PWM is reduced by 35. For moves in the wiper up direction a move is started with a PWM of SEED+10 for 15 ms after which the PWM is reduced to ⅝ SEED.

While a preferred embodiment of the invention has been described in specific detail, it will be understood that various modifications and substitutions may be made in the described embodiment without departing from the spirit and scope of the invention as defined by the appended claims.

We claim:

1. A maintenance station for an ink jet printer, said printer including a printhead having nozzles in one surface thereof, said printhead being movable adjacent to and on a first side of a plane in which records are fed, said maintenance station being mounted entirely on a second side of said plane opposite said first side and including a wiper, a cap, and drive means for alternately moving said wiper and said cap into contact with said one surface of said printhead by simultaneously moving said wiper and said cap in a first direction and second direction, respectively, said first direction being opposite to said second direction.

2. A maintenance station for an ink jet printer, said printer including a printhead having nozzles in one surface thereof, said printhead being movable adjacent to and on a first side of a plane in which records are fed, said maintenance station including a wiper, a cap, and drive means for moving said wiper and said cap into contact with said one surface of said printhead, said means for moving said wiper and said cap into contact with said one surface comprising a rocker element pivoted in a frame and means mechanically linking said cap and said wiper to said rocker element whereby said cap is moved toward said one surface as said wiper is moved away from said one surface and said wiper is moved toward said one surface as said cap is moved away from said one surface.

3. A maintenance station as claimed in claim 2 and further including guide means for guiding said wiper and said cap along parallel paths normal to said plane.

4. A maintenance station as claimed in claim 3 in which said guide means comprises a guide post extending from said frame, the guide post having a tri-ribbed shape.

5. A maintenance station as claimed in claim 3 wherein said means for moving said wiper and said cap into contact with said one surface comprises a rocker element pivoted in a frame and means mechanically linking said cap and said wiper to said rocker element whereby said cap is moved toward said one surface as said wiper is moved away from said one surface and said wiper is moved toward said one surface as said cap is moved away from said one surface.

6. A maintenance station as claimed in claim 3 wherein said guide means comprises a guide post extending from said frame and said means for mechanically linking said wiper to said rocker element comprises a spit cup in which said wiper is mounted, said spit cup having outwardly extending projections for engaging a pair of slots provided in sides of said rocker element, said spit cup being mounted for sliding movement on said guide post.

7. A maintenance station as claimed in claim 3 wherein said guide means comprises a guide post extending from said frame and said means for mechanically linking said cap to said rocker element comprises a cap mount on which said cap is mounted, a cap slide, and a compression spring, said cap mount having an elongated portion which extends through said compression spring and a hole in said cap slide, said cap mount having a hole extending therethrough into which said guide post extends, said cap slide having projections thereon for engaging a pair of slots provided in sides of said rocker element.

8. A maintenance station for a printer, said printer including, a middle frame with an upper surface defining a record feed path, and, an ink jet printhead movable transverse to said record feed path on one side thereof;

said maintenance station comprising, a rocker module and a drive module, means on said rocker module, said drive module and said middle frame for supporting said rocker module and said drive module from said middle frame with upper surfaces of said rocker module and said drive module being coplanar with an upper surface of said middle frame, said rocker module including a wiper and a cap movably mounted therein and a pivoted rocker element for moving said wiper and said cap toward and away from said printhead, said drive module including drive means engaged with said rocker element for pivoting said rocker element to thereby move said cap and wiper between a first position where the wiper is in contact with the printhead, a second position where the cap is in contact with the printhead, and a third position where the cap and wiper are below the upper surface of the rocker module.

9. A maintenance station as claimed in claim 8 wherein said drive means comprises a motor, gearing means driven by said motor, and a nut driven by said gearing means, said nut having a pair of arms with forked ends for engaging projections provided on said rocker element.

10. A maintenance station as claimed in claim 8 wherein said rocker module includes a rocker module frame and said drive module includes a drive module frame and said means for supporting said rocker module and said drive module comprises grooves in said rocker module frame and said drive module frame and tongues on said middle frame whereby said rocker module frame and said drive module frame may slide into place in said middle frame.

11. A maintenance station as claimed in claim 10 wherein hook portions are provided on at least some of said tongues at an end thereof, said hook portions engaging one of a group of frames comprising said rocker module frame and said drive module frame to thereby hold both said rocker module frame and said drive module frame.

12. A maintenance station as claimed in claim 11 wherein portions of said middle frame are cut away adjacent said tongues at said ends where said hook portions are provided.

13. A maintenance station as claimed in claim 11 wherein said rocker module is slid onto said tongues prior to said drive module whereby said hook portions engage the frame of said drive module to hold both said rocker module and said drive module in place.

14. A maintenance station for an ink jet printer, said maintenance station comprising:

a rocker module including a frame having a rocker element pivotally supported therein and a wiper and a cap movable in response to movement of said rocker element so as to position the wiper, the cap, or neither the wiper nor the cap above the frame, said rocker element having at least one projection thereon; and, a drive module including a drive motor, a nut having at least one forked arm for engaging said at least one projection, and gear means responsive to said drive motor for moving said nut to thereby pivot said rocker element to position said wiper and said cap.

15. A maintenance station as claimed in claim 14 wherein said drive motor is a DC motor.

16. A maintenance station as claimed in claim 15 and having only two electrical leads connected thereto, said leads being connected at one end to said motor.

17. A maintenance station as claimed in claim 16 and further comprising a controller connected to said leads, said controller including means for applying signals to said motor to position said wiper and said cap.

18. A maintenance station as claimed in claim 17 wherein said means for applying signals comprises means for applying pulse-width-modulated pulses of a first or a second polarity to said leads.

19. A maintenance station as claimed in claim 14 and further comprising a controller connected to said drive motor, said controller including means for applying a voltage to said motor to induce a current in said motor, said controller also including means for sensing said current to determine the position of said cap and wiper and means operable at controller start-up time for determining an interval of time that said motor must be energized in order to move said rocker element from a position where the wiper or cap is above said frame to the position where neither the wiper nor the cap is above the frame.

20. A maintenance station as claimed in claim 14 wherein said drive module includes a monolithic plastic frame, said drive motor being mounted on a side wall of said frame with a shaft of said motor extending through said side wall, said gear means including a worm gear mounted on said shaft.

21. A maintenance station as claimed in claim 20 wherein said monolithic plastic frame has a top portion and a bottom portion, a pivot shaft mounted in said top and bottom portions, said gear means further comprising a helical gear mounted on said pivot shaft and engaging said worm gear, and a power screw mounted on said pivot shaft and driven by said helical gear, said nut being mounted on said power screw.

22. A maintenance station as claimed in claim 21 wherein thread-like projections with blunt ends are provided on one face of said helical gear, said thread-like projections extending into thread-grooves on said power screw, said nut having threads with blunt ends for engaging said thread-like projections to thereby prevent said nut from being driven into said one surface of said helical gear.

23. A maintenance station as claimed in claim 22 wherein the thread grooves of said power screw terminate at blunt stops for engaging the threads of said nut to prevent said nut from being driven into engagement with said top portion of said monolithic plastic frame.

24. A maintenance station for the printhead of an ink jet printer, said maintenance station comprising:

a cap;

a wiper;

a motor;

means driven by said motor for concurrently moving said wiper and said cap between a first position in which the wiper contacts the printhead and said cap is spaced from the printhead, a second position where the cap contacts the printhead and said wiper is spaced from the printhead, and a third position where the cap and wiper are approximately equally spaced from the printhead; and, a controller connected to said motor for selectively energizing said motor to thereby selectively move said cap and said wiper between said first position, said second position, and said third position.

25. A maintenance station as claimed in claim 24 wherein said controller includes means operative upon application of power to said controller for determining the interval of time said motor should be energized to move said wiper and cap between said first or said second position and said third position.

26. A maintenance station as claimed in claim 25 wherein the means for determining the interval of time includes a current sensor for sensing current flow in the motor.

* * * * *